US009022235B2

(12) United States Patent
Kalinsky

(10) Patent No.: US 9,022,235 B2
(45) Date of Patent: May 5, 2015

(54) FOOTWEAR HANGER ASSEMBLY

(76) Inventor: Stuart Kalinsky, New York, NY (US)

( * ) Notice: Subject to any disclaimer, the term of this patent is extended or adjusted under 35 U.S.C. 154(b) by 0 days.

(21) Appl. No.: 13/366,631

(22) Filed: Feb. 6, 2012

(65) Prior Publication Data

US 2013/0200015 A1 Aug. 8, 2013

(51) Int. Cl.

| | |
|---|---|
| ***A47F 7/08*** | (2006.01) |
| ***A47G 25/00*** | (2006.01) |
| *A47F 5/00* | (2006.01) |

(52) U.S. Cl.

CPC ..... *A47G 25/005* (2013.01); *A47F 5/0006* (2013.01)

(58) Field of Classification Search

USPC ..... 206/493, 461, 806, 458, 495; 223/85, 223/87; 248/339, 340; 211/85.3, 113, 119, 211/339, 340, 34; 11/493, 461, 806, 458, 11/495

See application file for complete search history.

(56) References Cited

U.S. PATENT DOCUMENTS

| | | | | |
|---|---|---|---|---|
| D218,847 | S * | 9/1970 | Specht | D32/59 |
| 4,346,825 | A * | 8/1982 | Leger | 223/66 |
| 4,638,915 | A * | 1/1987 | Kaplan | 211/85.3 |
| 4,823,962 | A * | 4/1989 | Arias | 211/34 |
| D307,603 | S * | 5/1990 | Goodman et al. | D19/34.5 |
| 4,978,043 | A * | 12/1990 | Uke | 223/88 |
| 5,282,553 | A * | 2/1994 | Ibled | 223/85 |
| 5,911,347 | A * | 6/1999 | Jackstat et al. | 223/85 |
| D426,926 | S * | 6/2000 | Julien | D32/59 |
| 6,678,971 | B2 * | 1/2004 | Brooks | 36/94 |
| D558,959 | S * | 1/2008 | Kalinsky | D2/916 |
| 7,997,464 | B2 * | 8/2011 | Weal et al. | 223/85 |
| 2004/0159686 | A1 * | 8/2004 | Huang | 223/85 |
| 2007/0251894 | A1 * | 11/2007 | Kelley | 211/34 |

FOREIGN PATENT DOCUMENTS

EP 2409606 A2 * 1/2012

* cited by examiner

*Primary Examiner* — Joshua Rodden
(74) *Attorney, Agent, or Firm* — Israel Nissenbaum

(57) ABSTRACT

A footwear hanger includes a suspension portion for suspending a pair of shoes having toe separators in as side-by-side relation in an upright position, and a pair of support portions connected to, and in mirror symmetrical relationship with, the suspension portion. Each support portion has a plurality of uprights together operative for jointly supporting one of the shoes. The uprights of each support portion are spaced apart from one another and include bound spaces in which the toe separators of the respective shoe are received for holding the shoe upright in the upright position.

5 Claims, 2 Drawing Sheets

FOOTWEAR HANGER ASSEMBLY

FIELD OF THE DISCLOSURE

The present disclosure relates generally to footwear hanger assemblies and, more particularly, to displaying or storing a pair of shoes, especially sandals having toe separators, also known as pedicure slippers, in a side-by-side relation, for merchandising or storage purposes.

BACKGROUND

The display of shoes for retail sales purposes, as well as the storage of shoes by a consumer, is often haphazard and totally lacking in organization. Many consumers simply store their shoes on a floor of a closet with no mechanical assistance whatever. More organized consumers may use door-mounted shoe racks or shoe bags, or may use floor-mounted shoe racks or shoe trees, to store their shoes. Although most retail stores continue to store most available pairs of shoes in a backroom, keeping them in individual boxes, many retail stores often make use of merchandising shelves to display samples of shoes which are either loose, or tied to one another, or boxed. Sometimes, the retail stores will suspend some styles of shoes from hangers.

As advantageous as the known techniques for merchandising and storing shoes have been, they are not altogether satisfactory when it is desired to display or store other styles of shoes, such as sandals, having toe separators, also known as pedicure slippers, such as exemplified by U.S. Pat. No. 6,151,801 and No. D-575,484. Such shoe styles have not heretofore been suspended from hangers, and, if attempted by the known hanger constructions, would not be readily frictionally gripped and held upright for display and storage purposes.

Accordingly, a need exists to display or store shoes having toe separators, and to produce a hanger for such purposes in an economic fashion.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
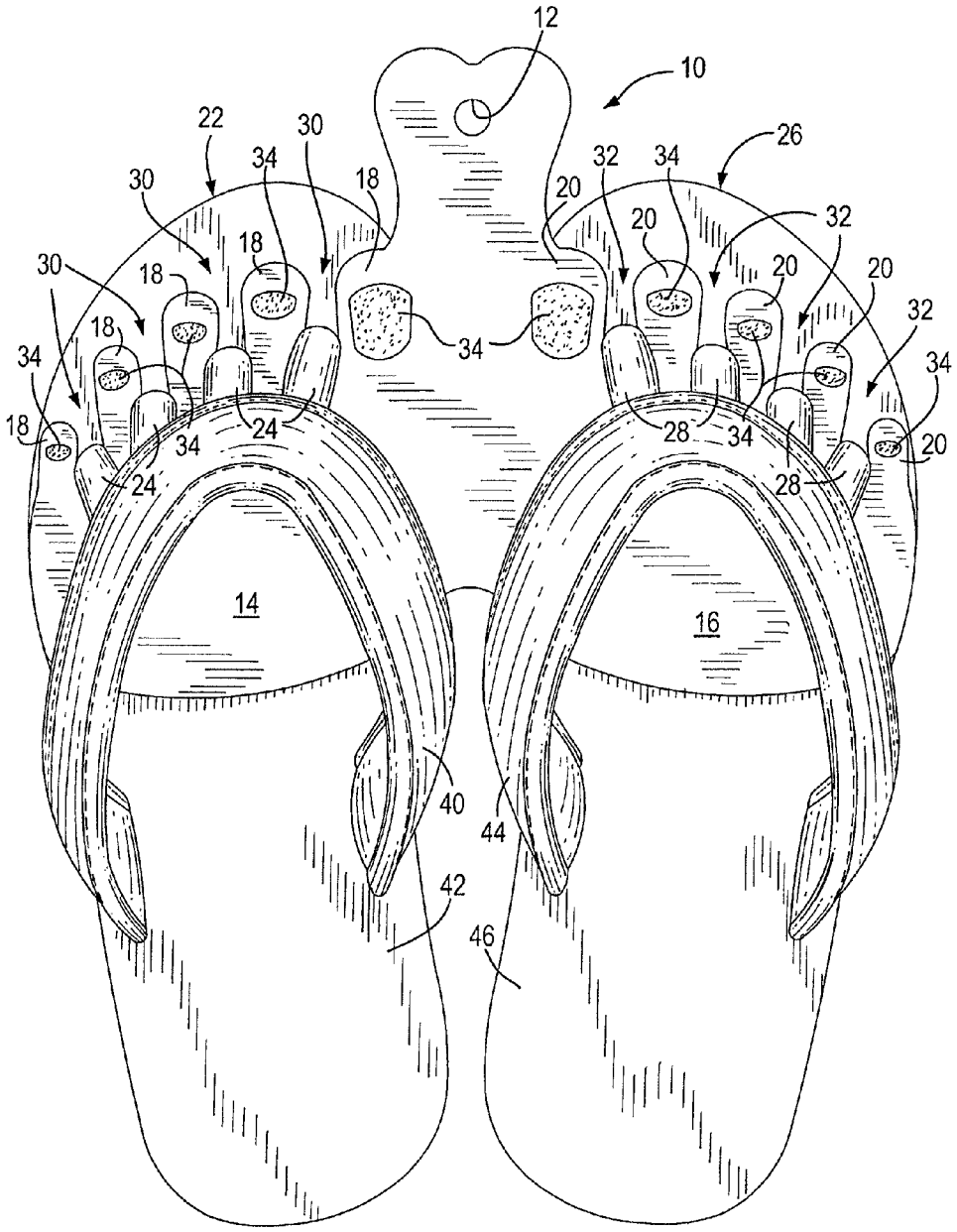
FIG. 1 is a front elevational view of a footwear hanger assembly for suspending a pair of shoes having toe separators for merchandising or for storage in accordance with this invention.
Figure 2:
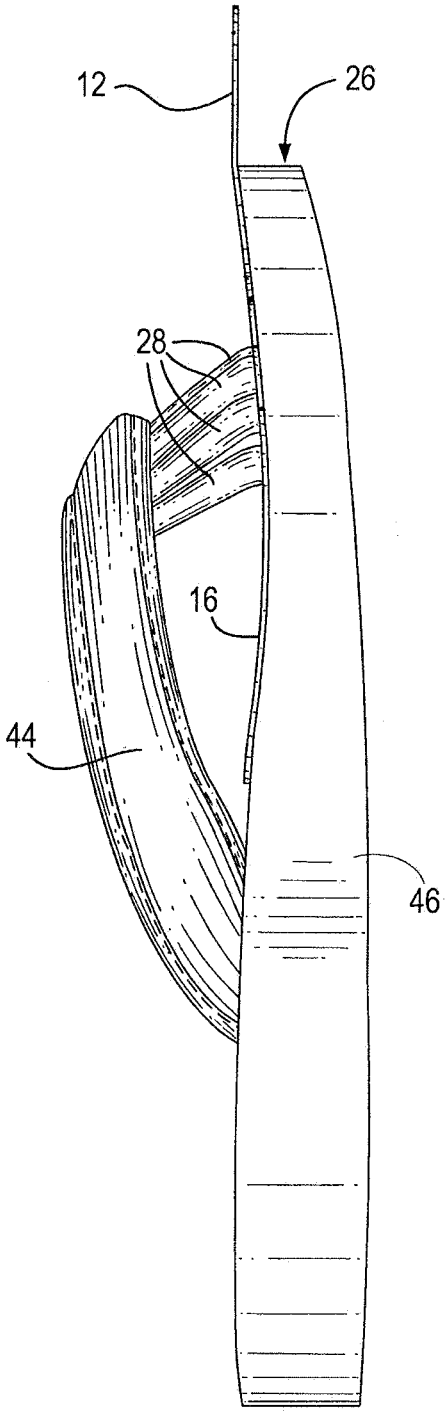
FIG. 2 is a side view of the assembly of FIG. 1.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The components of the footwear hanger assembly have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

A footwear hanger, in accordance with one feature of this invention, comprises a suspension portion for suspending footwear in an upright position, and a support portion connected to the suspension portion. The support portion has a plurality of uprights together operative for jointly supporting a shoe, such as a sandal having toe separators, also known as pedicure slippers. The uprights are spaced apart from one another and bound spaces in which different portions of the shoe, e.g., the toe separators, are received for holding the shoe upright in the upright position.

Advantageously, the hanger comprises another support portion connected to the suspension portion. The support portions are mirror symmetrically arranged relative to the suspension portion. The other support portion has another plurality of uprights together operative for jointly supporting another shoe, such as another sandal having toe separators. The other uprights are spaced apart from one another and bound spaces in which different portions of the other shoe, e.g., the toe separators, are received for holding the other shoe upright in the upright position. The suspension portion, the support portions and the uprights are preferably constituted as a generally planar member of one-piece, molded plastic construction. Advantageously, the shoes constitute a pair, i.e., a right shoe for wearing on one's right foot, and a left shoe for wearing on one's left foot. The pair is held upright in a side-by-side relation. The pair of shoes and the hanger constitute a footwear hanger assembly.

In a preferred embodiment, the support portions are generally configured as human feet in plan view, and the uprights are generally configured as human toes in plan view. Graphical representations of toenails are advantageously on the uprights. Thus, in the merchandising upright display position, the hanger itself depicts how a consumer is to use the hanger.

Turning now to the drawings, reference numeral 10 in FIG. 1 generally identifies a footwear hanger assembly which includes a suspension portion 12, e.g., a hook or a hole, for suspending footwear, as described below, in an upright position, e.g., from a rod, peg or like supporting structure, and at least one support portion, and preferably a pair of left and right support portions 14, 16 connected to, and mirror symmetrically arranged relative to, the suspension portion 12.

The left support portion 14 has a plurality of left uprights 18 together operative for jointly supporting a left shoe 22, such as a left sandal or pedicure slipper having left toe separators 24 extending between an upper portion or left strap 40 and a lower portion or left sole 42. The left uprights 18 are spaced apart from one another and bound left spaces 30 in which the left toe separators 24 are received for holding the left shoe 22 upright in the upright position. The left strap 40 and the left sole 42 flank the left support portion 14. The right support portion 16 has a plurality of right uprights 20 together operative for jointly supporting a right shoe 26, such as a right sandal or pedicure slipper having right toe separators 28 extending between an upper portion or right strap 44 and a lower portion or right sole 46. The right uprights 20 are spaced apart from one another and bound right spaces 32 in which the right toe separators 28 are received for holding the right shoe 26 upright in the upright position. The right strap 44 and the right sole 46 flank the support portion 16. The shoes 22, 26 are held upright in a side-by-side relation.

In a preferred embodiment, the support portions 14, 16 are generally configured as left and right human feet in plan view, and the left and right uprights 18, 20 are generally configured as human toes in plan view. Graphical representations 34 of toenails are advantageously provided on the uprights 18, 20. Thus, in the merchandising upright display position, the hanger itself depicts how a consumer is to hang the shoes 22, 26 on the hanger. The suspension portion 12, the support portions 14, 16 and the uprights 18, 20 are preferably constituted as a generally planar member of one-piece, molded plastic construction.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings For example, the number of uprights 18, 20 need not each be five as illustrated, but could be a different number. The number of toe separators 24, 28 need not each be four as illustrated, but could be a different number. Advantageously, the uprights 18, 20 have different heights in order to better simulate human toes. The graphical representations 34 of toenails can be applied as coats of colored paint. Graphical representations, other than toenails, such as stars, could also be employed. Advertising or like indicia can also be applied to the hanger.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing," or any other variation thereof, are intended to cover a non-exclusive inclusion, such that a process, method, article, or apparatus that comprises, has, includes, or contains a list of elements does not include only those elements, but may include other elements not expressly listed or inherent to such process, method, article, or apparatus. An element proceeded by "comprises . . . a," "has . . . a," "includes . . . a," or "contains . . . a," does not, without more constraints, preclude the existence of additional identical elements in the process, method, article, or apparatus that comprises, has, includes, or contains the element. The terms "a" and "an" are defined as one or more unless explicitly stated otherwise herein. The terms "substantially," "essentially," "approximately," "about," or any other version thereof, are defined as being close to as understood by one of ordinary skill in the art, and in one non-limiting embodiment the term is defined to be within 10%, in another embodiment within 5%, in another embodiment within 1%, and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. A footwear hanger configured for suspending, a pair of right and left pedicure slippers, each pedicure slipper having a strap with two ends, a sole with a longitudinal axis, with the two ends of the strap being affixed to the sole whereby the strap extends across the longitudinal axis, and a plurality of toe separators with respective spaces between the toe separators, the toe separators extending between, and connected to the strap and the sole, the toe separators the strap and the sole of each left and right pedicure slipper defining an enclosed lateral opening. extending in a direction generally aligned with the longitudinal axis, with each of the enclosed lateral openings of the left and right pedicure slippers adjacently facing each other when the respective slippers are positioned for being suspended by the footwear hanger, the footwear hanger comprising:

a generally planar hanger member, the hanger member including a suspension portion for suspending the pedicure slippers in a side-by-side relation in an upright position, and a pair of partial front end right and left human foot-shaped support portions arranged mirror symmetrically and connected to the suspension portion, the right foot-shaped support portion having a plurality of human right toe-shaped uprights spaced apart from one another and bounding right spaces for receiving the toe separators of the right pedicure slipper, and the left foot-shaped support portion having a plurality of human left toe-shaped uprights spaced apart from one another and bounding left spaces for receiving the toe separators of the left pedicure slipper, the partial front end right and left human foot-shaped support portions being sized and configured for respective insertion through the respective adjacently facing lateral openings for being positioned for the respective receiving of the toe separators of the right and left pedicure slippers and Wherein the toe-shaped uprights remain visible While the pedicure slippers are suspended on the planar hanger member to simulate a view of actual wearing of the pedicure slippers, wherein the plurality of toe-shaped uprights of each of the right and left foot-shaped support portions has four human toe-shaped uprights spaced apart from one another and bounding three of the respective right and left spaces for receiving three of the toe separators of the respective right and left pedicure slippers, and with an end big toe of the right and left foot-shaped support portions being respectively partially integrated with the suspension portion and being spaced apart from an adjacent one of the toe-shaped uprights to provide a fourth one of the respective right and left spaces for receiving a fourth one of the toe separators.

2. The footwear hanger of claim 1, wherein the hanger member further including a first plurality of graphical representations of human right toenails on the right toe-shaped uprights to guide placement of the toe separators of the right pedicure slipper into the right spaces, and a second plurality of graphical representations of human left toenails on the left toe-shaped uprights to guide placement of the toe separators of the left pedicure slipper into the left spaces.

3. The footwear hanger of claim 1 wherein the hanger member consists essentially of a planar one-piece molded plastic element.

4. The footwear hanger of claim 1, wherein the suspension portion comprises a suspension element for hanging the footwear hanger on a support structure with the suspension element being entirely positioned vertically above the respective ends of the straps of the right and left pedicure slippers when the pedicure slippers are suspended on the footwear hanger assembly.

5. A footwear hanger system comprising:

a pair of right and left pedicure slippers, and a one-piece hanger element removably engaged with the pair of right and left pedicure slippers for at least one of the storage and display suspending of the pedicure slippers, wherein each pedicure slipper has:

a strap with two ends, a sole with a longitudinal axis, with the two ends of the strap being affixed to the sole whereby the strap extends across the longitudinal axis, and a plurality of toe separators, with respective spaces between the toe separators, the toe separators extending between, and connected to the strap and the sole, the toe separators, the strap and the sole of each left and right pedicure slipper defining an enclosed lateral opening extending in a direction generally aligned with the longitudinal axis, with each of the enclosed lateral openings of the left and right pedicure slippers adjacently facing each other with the respective slippers being suspended by the hanger element, the hanger element comprising:

generally planar hanger member, the hanger member including:

a suspension portion for suspending the pedicure slippers in a side-by-side relation in an upright position, and a pair of partial front end right and left human foot-shaped support portions arranged mirror symmetrically and connected to the suspension portion, the right foot-shaped support portion having a plurality of human right toe-shaped uprights spaced apart from one another and bounding right spaces for receiving the toe separators of the right pedicure slipper, and the left foot-shaped support portion having a plurality of human left toe-shaped uprights spaced apart from one another and bounding left spaces for receiving the toe separators of the left pedicure slipper, the partial front end right and left human foot-shaped support portions being sized and configured for respective insertion through the respective adjacently lacing lateral openings for being positioned for the respective receiving of the toe separators of the right and left pedicure slippers and wherein the toe-shaped uprights remain visible while the pedicure slippers are suspended on the planar hanger member to simulate a view of actual wearing of the pedicure slippers, wherein the plurality of toe-shaped uprights of each of the right and left foot-shaped support portions has four human toe-shaped uprights spaced apart from one another and bounding three of the respective right and left spaces for receiving three of the toe separators of the respective right and left pedicure slippers, and with an end big toe of the right and left foot-shaped support portions being respectively partially integrated with the suspension portion and being spaced apart from an adjacent one of the toe-shaped uprights to provide a fourth one of the respective right and left spaces for receiving a fourth one of the toe separators.

* * * * *